United States Patent [19]

Ono et al.

[11] 4,443,123

[45] Apr. 17, 1984

[54] SMALL SERIAL PRINTER

[75] Inventors: Keikichi Ono, Chichibu; Hirofumi Hirano, Saitama, both of Japan

[73] Assignee: Canon Denshi Kabushiki Kaisha, Tokyo, Japan

[21] Appl. No.: 391,863

[22] Filed: Jun. 24, 1982

[30] Foreign Application Priority Data

Jul. 7, 1981 [JP] Japan ..... 56-104966

[51] Int. Cl.[3] ..... B41J 1/20; B41J 1/34

[52] U.S. Cl. ..... 400/145.2; 400/146; 101/93.14

[58] Field of Search ..... 400/142, 145.2, 145.1, 400/146, 164.5, 164.6, 145, 904, 144.1, 251, 259, 82; 101/93.13, 93.14, 93.17

[56] References Cited

U.S. PATENT DOCUMENTS 723,855 3/1903 Frantz ..... 400/145.2

4,026,404 5/1977 Burkhardt ..... 400/259 X

FOREIGN PATENT DOCUMENTS 55-161656 12/1980 Japan ..... 400/146

*Primary Examiner*—Edgar S. Burr

*Assistant Examiner*—Charles A. Pearson

*Attorney, Agent, or Firm*—Fitzpatrick, Cella, Harper & Scinto

[57] ABSTRACT

A serial printer has a type drum rotating about a rotation axis perpendicular to the direction of the line of a paper and a carriage for carrying said type drum in the direction of the line. The carriage has a type drum comprising a base member and type belts disposed round said base member at different levels, and a hammer rotatably supported on said carriage. One end of said hammer is led into the interior of said drum and disposed opposed to the type part of said type drum. Another end of said hammer is in the exterior and disposed to contact with a cam. When said another end comes into contact with said cam, said hammer is rotated by said cam whereby a type on said type belts is pushed out against the paper by said one end of said hammer to effect printing.

3 Claims, 21 Drawing Figures

SMALL SERIAL PRINTER

BACKGROUND OF THE INVENTION

1. Field of the Invention

The present invention relates to a small serial printer and more particularly a small serial printer which is able to operate at high speed without noise and which is low in cost and small in power consumption.

2. Description of the Prior Art

The conventional serial printer according to the prior art includes a type drum mounted on a horizontal rotation axis with the type drum being disposed vertically relative to the printing paper. With this type of the printer, the serial printing is effected through the operation steps of rotating the type drum, stopping the rotation of the type drum, impacting and advancing (or digit-up) the type drum. Although this type of serial printer is now being widely used, it has some drawbacks. Firstly, an expensive pulse motor is required to control the driving of the type drum and the above printing operations. Secondly, it needs a complicated mechanism. These make the printer very expensive as a whole. Thirdly, since it employs the impact printing system, the noise generated at printing is large and also the printing speed is relatively low. Lastly, it consumes a large amount of electric power.

SUMMARY OF THE INVENTION

Accordingly, it is the general object of the invention to overcome the above drawbacks of the prior art printer.

More specifically, it is an object of the invention to provide a small serial printer which is able to operate at a higher speed without generating a large amount of noise during printing.

It is another object of the invention to provide a small serial printer which reduces the power consumption to a great extent.

To attain the above objects according to the invention, there is provided such a serial printer comprising a type drum rotating about a rotation axis perpendicular to the direction of the line of the printing paper, a carriage for carrying said type drum in the direction of the printing line and a control member for rotating said type drum. The printer obtained by the present invention is small in size and inexpensive as a whole.

The basic arrangement of the printer is disclosed in Japanese Patent Application 56-46635 filed on Mar. 30, 1981 the counterpart of which is U.S. patent application Ser. No. 356,101, filed Mar. 8, 1982, pending.

Other and further objects, features and advantages of the invention will appear more fully from the detailed description taken in connection with the accompanying drawings.

BRIEF DESCRIPTION OF THE DRAWINGS

The accompanying drawings illustrate an embodiment of the invention, in which.

DETAILED DESCRIPTION OF THE PREFERRED EMBODIMENTS

Figure 1:
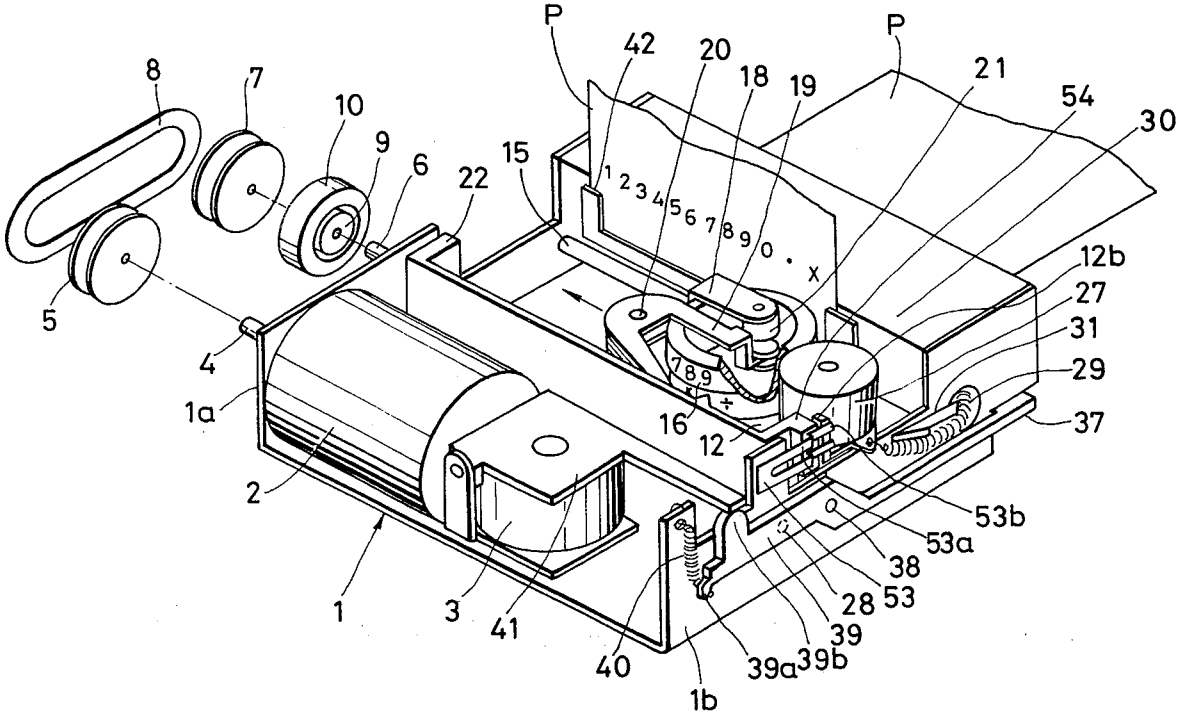
FIG. 1 is a perspective view of it.

Referring first to FIG. 1 there is shown a small printer according to the invention.

1 is a case-like frame serving as a base on which all the elements of the printer are assembled together. On one side of the frame there are arranged a motor 2 and a solenoid 3. The solenoid 3 functions as a trigger to drive a control mechanism as later described. The output shaft 4 of the motor 2 extends beyond the left-hand side plate 1*a* of the frame 1. Fixed on the free end of the output shaft 4 is a pulley 5 connected to a second pulley 7 by a belt 8. The second pulley 7 is fixed on the outer end of a rotary shaft 6 rotatably received by the frame 1 and extending in parallel to the output shaft 4. The rotation of the motor 2 is therefore transmitted to the rotary shaft 6 through the belt 8 disposed around the pulleys 5 and 7. At the inside of the pulley 7, the rotary shaft has a tacho-generator coil 10 provided with a tacho-generator magnet 9 mounted on the shaft for rotation together with the shaft 6. The tachometer generator is provided to detect the timing pulse informing of the type position of a type drum 16.

Figure 2:
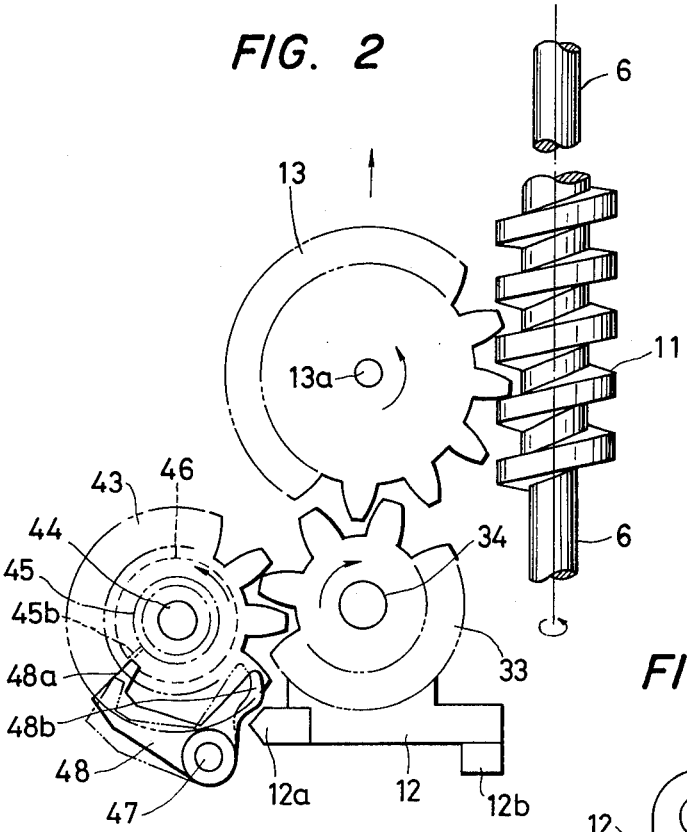
FIG. 2 is a bottom view showing the gear train arranged on the backside of the carriage.
Figure 3:
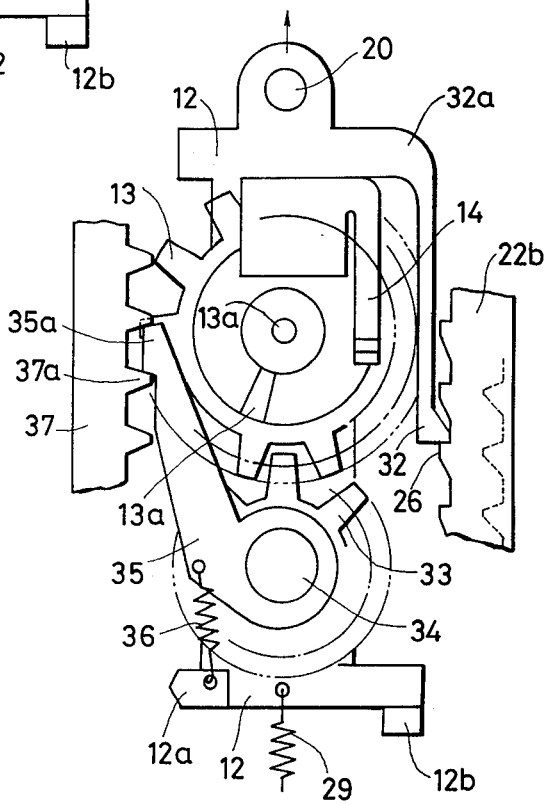
FIG. 3 is a bottom view of the carriage.

Also, a worm gear 11 is fixedly mounted on the rotary shaft 6 as shown in FIG. 2. The worm gear 11 is always in mesh with a drum gear 13 formed integrally with the type drum 16 and rotatably supported by the frame 1. The drum gear 13 has a projection 13*a* projecting from the side surface of the gear. As shown in FIG. 3, the projection 13*a* is engageable with a reset pulse signal detecting contact 14 provided on a part of a carriage 12.

Figure 5:
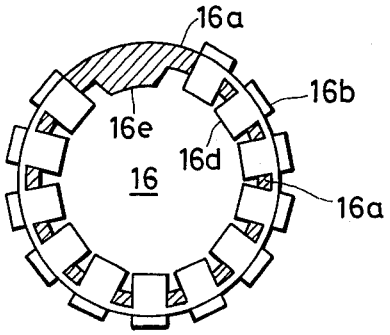
FIG. 5 is a cross-sectional view of the type drum.
Figure 4:
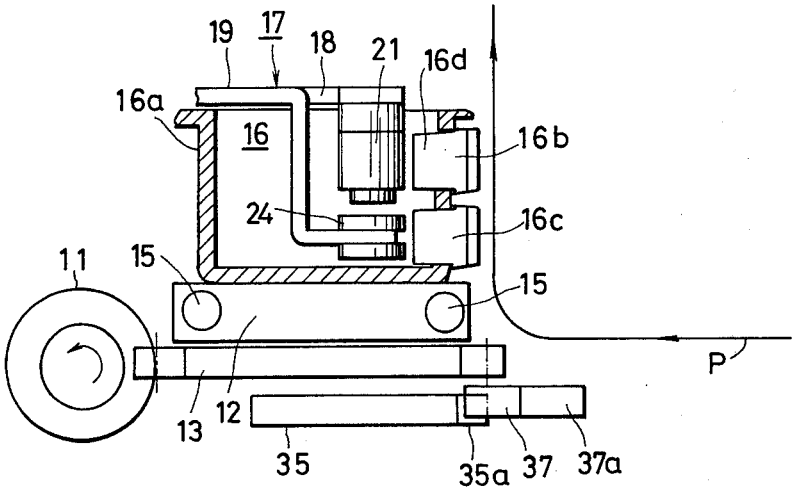
FIG. 4 is a side view, partly in section through the type drum vertically showing the mechanism for controlling the driving of the carriage.

The carriage 12 is movable along a pair of guide rods 15, 15 shown in FIG. 4. The above drum gear 13 is mounted on the under side surface of the carriage 12. On the upper side surface of the carriage 12 and coaxially with the drum gear 13 there is supported the type drum 16 for rotation. The structure of the type drum 16 is shown in detail in FIG. 5. The type drum 16 comprises a cylindrical base 16*a* around which a numeric type belt 16b and a symbol type belt 16c are disposed. The backside surface of each the type belts is projected into the interior of the cylindrical base 16a passing through openings formed thereon. The type belt also includes a blank type portion corresponding to the area of two symbols or numerals.

Disposed above the type drum 16 is a hammer unit 17 comprising a lower numeric printing hammer 18 and an upper symbol printing hammer 19. As seen best in FIG. 6, each hammer is formed as a V-shaped member and supported by a pivot 20 at the base portion of the hammer for rotation about the pivot. The numeric printing hammer 18 has a printing roller 21 rotatably mounted on the under surface of the free end of one arm 18a of the V-shaped hammer. The printing roller 21 is inserted into the type drum 16 so as to face the backside of the numeric type belt 16b. The other arm 18b of the numeric printing hammer extends toward a cam plate 22 arranged between the rotary shaft 6 and the motor 2 and along the rotary shaft 6. The cam plate 22 has an L-form cross-section and projections 23 are formed on the inside surface of the vertical wall portion 22a of the cam plate. The projections 23 are so disposed as to contact with the tip end of the other arm 18b of the numeric printing hammer 18.

A curved arm of the symbol printing hammer 19 has a fore end portion bent into the type drum 16. At the free end of the curved arm the symbol printing hammer has a printing roller 24 rotatably supported by it. The symbol printing roller 24 lies just under the above-mentioned numeric printing roller 21 and is disposed so as to face the backside of the symbol type belt 16c. Another arm 19b of the V-shaped symbol printing hammer extends toward the cam plate 22. The tip end of the arm 19b is engageable with a projection 25 formed on the inner surface of the vertical wall portion 22a of the cam plate at a higher height than the aforementioned projections 23. These projections 23 and 25 are so formed as to have a simple triangular cross-section. Therefore, the arms 18b and 19b can ride over the projections 23 and 25 from either direction.

Figure 6:
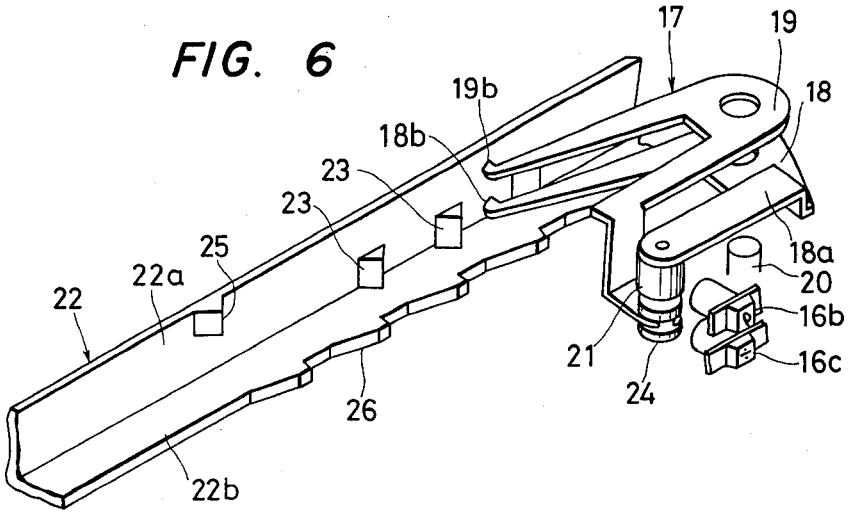
FIG. 6 is a perspective view illustrating the operational relation between the printing hammer and the cam member.

As shown in FIG. 6, the horizontal wall portion 22b of the cam plate 22 has a series of nearly triangular projections 26 formed along the outer side edge of the portion 22b. As a whole, these projections 26 look like saw teeth. Each projection 26 is shaped in such a manner that one side of the triangle opposed to the hammer unit provides a vertical wall. As shown in FIG. 3, an elastic pawl 32 is formed at one end of the carriage 12. The tip end 32a of the pawl 32 is engageable with the above projection 26.

Referring again to FIG. 1 there is provided an ink roller 27 near the type drum 16. The ink roller 27 is also carried on the carriage 12 and rotatably supported. The circumferential surface of the ink roller 27 is always in contact of the circumference of type drum 16 to apply ink to the latter.

Figure 7:
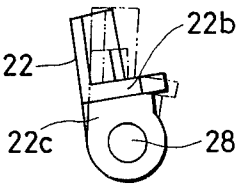
FIG. 7 is a plan view illustrating the operation of carriage return.

The cam plate 22 has a bracket 22c downwardly projected from the under side of the plate 22. As shown in FIG. 7, the cam plate is supported by a shaft 28 through the bracket 22c for free rotation about the shaft 28 within a limited rotation angle range. Although not shown in the drawing, the cam plate is biased by a spring intending to rotate the cam plate clockwise as viewed in the drawing.

Designated by 29 in FIG. 1 is a return spring one end of which is fastened to one end of the carriage 12. Another end of the return spring 29 extends along arcuate guide 31 on the side surface of the right-hand side plate 1b and passes through the inner room of a platen 30. After passing through it, the spring end is anchored on the left-hand side plate 1a. By this return spring 29, the carriage 12 is biased to move rightward. However, when the pawl 32 of the carriage is in engagement with the projection 26 on the cam plate 22 as shown in FIG. 3, the rightward movement of the carriage 12 is limited against the biasing force of the return spring 29.

The drum gear 13 is always in mesh with a driving gear 33 rotatably mounted on a shaft 34 as shown in FIG. 2.

On the rotating shaft 34 there is mounted also one end of a control lever 35 as shown in FIG. 3. A spring 36 is disposed between the carriage 12 and the control lever 35. By the spring 36 the control lever is biased to rotate counter-clockwise. The free end 35a of the control lever is engageable with the tooth 37a of a rack 37 arranged at the side of the carriage and in parallel with the cam plate 22b. With the rack teeth 37a the above described drum gear 13 is also engageable. The rack 37 is supported by the shaft 38 on the right-hand side plate 1b for rotation about the shaft within a limited range of rotation angle.

As seen in FIG. 1, the rack 37 is in the form of "]" as a whole. It extends at first along the right-hand side plate 1b, then passing under the platen 30 and finally along the left-hand side plate 1a. On the side of the left-hand side plate 1a, the rack is supported by a shaft (not shown) outwardly projecting from the side plate 1a in axial alignment with the shaft 38 on the side of the right-hand side plate 1b. On the side of this side plate 1b and in the area beyond the shaft 38, the rack 37 has a rack lever 39 formed as an integral part of the rack. Between the free end 39a of the rack lever and the upper portion of the side plate 1b there is disposed a spring 40 which has a bias force tending to rotate the whole of the rack 37 clockwise as viewed in FIG. 1. At the portion near the free end 39a, the rack lever 39 has an upward projection 39b opposed to the fore end of an armature 41 of the solenoid 3.

A printing paper P is guided by the paper guide 42, passing upwards through between the platen 30 and the type drum 16. At the right-hand under portion of the platen 30 as viewed in the drawing of FIG. 1, there is provided a clutch gear 43 rotatable about a shaft 44. When the carriage 12 reaches the right-hand end area, the clutch gear 43 comes into mesh with the driving gear 33 as shown in FIG. 2.

Figure 8:
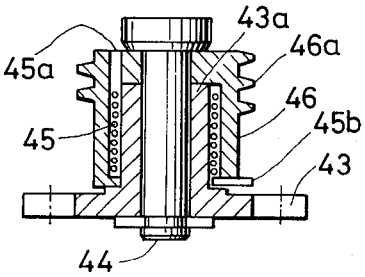
FIG. 8 is a sectional view of the spring clutch.

FIG. 8 is a sectional view of the clutch gear 43.

Disposed around the boss part 43a of the gear 43 is a coil spring 45 for forming a spring clutch. One end 45a of the coil spring 45 is fastened to a PF (paper feed) worm 46. Another end 45b of the coil spring is projected outwards over the lower end of the PF worm 46. The projected spring end 45b is adapted to engage the free end 48a of a PF lever 48 in the vicinity of the clutch gear 43. The PF lever 48 is supported by a shaft 47 for rotation about the shaft. As seen in FIG. 8, the PF worm 46 is cylindrical and fitted on the coil spring 45. The cylindrical PF worm 46 is rotatable about the shaft 44.

Figure 9:
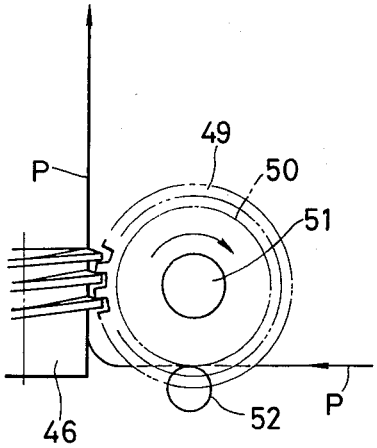
FIG. 9 is a side view illustrating the paper feed mechanism.

The gear teeth 46a of the PF worm 46 is in mesh with the PF gear 49 as shown in FIG. 9. The PF gear 49 is fixedly mounted on a shaft 51 integrally formed with PF rubber roller 50. Under the rubber roller 50 there is a small diameter pinch roller 52 with its circumference being in contact with the circumference of the rubber roller 50. The printing paper P passes through between the two rollers 50 and 52 and is moved upwards with the rotation of the rubber roller 50 through the PF gear 49.

Fixed to a portion of the right-hand side plate 1*b* is a leaf spring 53 in the form of "]" as a whole. The free end portions 53*a* and 53*b* of the two legs of the leaf spring are so bent as to describe L as seen in FIG. 1. The cam plate 22 has a projection 54 at the right-hand end portion of the plate. The projection 54 is engageable with the above bent free ends 53*a*, 53*b* of the leaf spring.

The manner of operation of the above printer is as follows:

With turn-ON of a power source switch, the motor 2 in FIG. 1 starts rotating. The rotation of the motor is transmitted to the drum gear 13 through pulley 5, belt 8, pulley 7, rotary shaft 6 and worm gear 11. Consequently, the type drum 16 starts rotating clockwise as viewed in FIG. 1.

Figure 10:
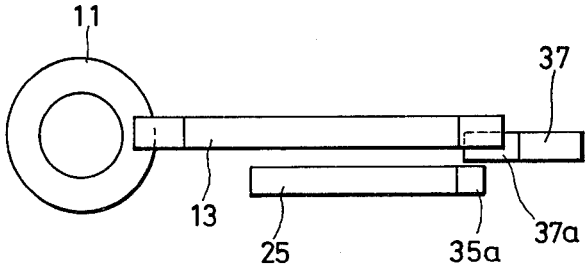
FIG. 10 is a side view illustrating the mechanism for controlling the driving of the carriage.

In this state of the type drum rotating continuously, any character to be printed is selected and current is applied to the solenoid 3. Thereby, the rack 37 is moved up from the position shown in FIG. 4 to the position shown in FIG. 10. When the rack tooth 37*a* gets in mesh with the driving gear 33, the drum gear 13 moves forward by its own rotational force against the spring 29 since the rack 37 is in a fixed position at the time. The type drum 16, therefore, moves leftwards while rotating thereby performing a carry motion.

Figure 11:
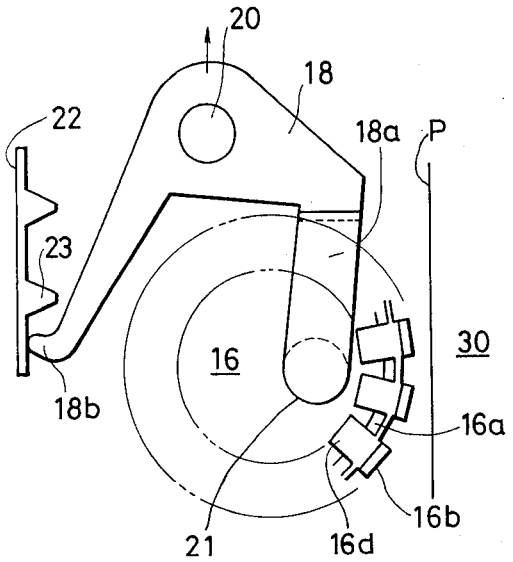
FIGS. 11 and 12 are views looking from the top in FIG. 1 illustrating the manner of operation of the printing hammer.
Figure 12:
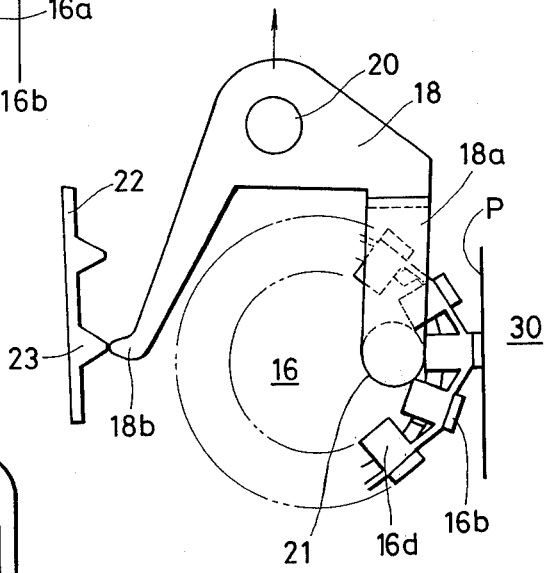

At the time, the hammer unit 17 also moves together with the carriage 12. FIGS. 11 and 12 illustrate, as an example, the numeric printing hammer 18 moving leftwards, that is, in the direction of arrow at this phase of operation. When the printing hammer 18 is moved to the position shown in FIG. 12 relative to the cam plate 22, the tip end of one arm 18*b* of the hammer rides on a projection 23 on the cam plate. Thereby the hammer 18 is rotated about the rotation axis 20 counter-clockwise as viewed in the drawing. As a result, the printing roller 21 on the free end of the other arm of the hammer 18 strikes a projection 16*d* on the backside of the type belt 16*b* and push it outwards. Therefore, the selected numeric type on the type belt 16*b* jumps against the printing paper P which is in turn pushed against the platen 30. Thus, the selected character is printed on the printing paper P. At this time, any rubbing relative movement between the type surface and the printing paper should be avoided. Otherwise, ink stains or ghost may be produced on the printing paper. For this purpose it is advisable that the platen 30 be located in a position in which the extension of the paper surface lies on the pitch circumference of the drum gear 13. By doing so, it is assured that during the printing there is obtained a perfect rolling contact between the selected type and the printing paper P.

At the moment when the tip end of the arm 18*b* of the printing hammer 18 has moved over the projection 23, the hammer 18 and the type belt 16*b* return back to their original positions as shown in FIG. 11. If the solenoid 3 continues to be energized after the above printing of one digit, then the engagement between the rack 37 and the drum gear 13 is maintained. Therefore, the carriage 12 continues moving for the next carry. When the printing hammer 18 is rotated by the next projection 23, the next printing is performed with the next positioned numeric type on the belt 16*b* in the same manner as above.

Figure 13:
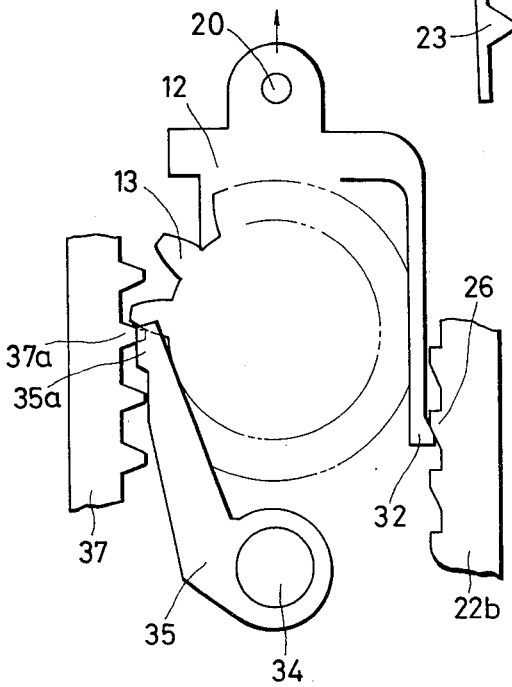
FIGS. 13 and 14 are views looking from the bottom in FIG. 1 illustrating the operational relations among the paper feed lever, the drum gear and the rack serving as a control member.
Figure 14:
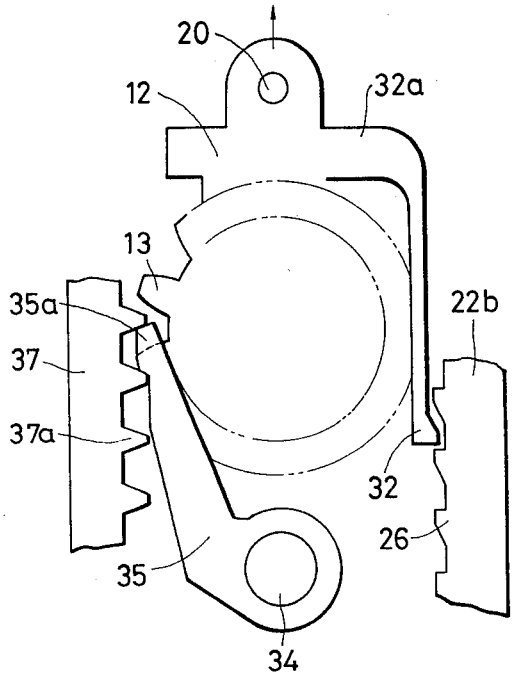

If it is wished to select a type other than the next one, the solenoid 3 is turned off to disengage the rack 37 from the drum gear 13. The rack 37 is returned to the position shown into FIG. 14. In this position, the teeth 37*a* of the rack get into engagement with the free end 35*a* of the control lever 35 in the manner shown in FIGS. 13 and 14. Now, the drum gear 13 rotates idly and the carry movement of the carriage 12 is stopped. At the same time, the pawl 32 of the carriage 12 gets into engagement with the projection 26 on the cam plate 22. Therefore, the carriage 12 can not be returned to its home position by the return spring 29 but it is held stopped at the position. When a character to be printed next is selected, the solenoid 3 is again excited to perform the next printing operation in the same manner as above.

To inform the control circuit of the position of the character to be printed there are used two signals, an initial position signal generated from the contact between the contact piece 14 and the projection 13*a* (FIG. 3) and a type position signal generated from the tachogenerator magnet-coil assembly 9, 10 (FIG. 1). Based on the two signals, the solenoid 3 is excited by the control circuit. On the actuation of the solenoid 3, the armature 41 pushes the rack lever 39 down thereby rotating the rack 37 counter-clockwise as viewed in FIG. 1. Thus, the rack 37 moves up from the position shown in FIG. 4 to the position shown in FIG. 10. In the latter position, the rack teeth 37 get in mesh with the drum gear 13. The carriage 12 starts to move and the tip end 35*a* of the control lever 35 is disengaged from the rack teeth 37*a*. The lever end 35*a* and the rack teeth get in a mere overlapped relation. In this state, the control lever 35 and the rack teeth 37*a* do not come into engagement with each other even when the current supply to the solenoid 3 is cut off. The carriage 12 is stopped first when they get in the state shown in FIG. 14 after completing the printing of one digit. In other words, the functions of the control lever 35 are to prevent the rack teeth 37*a* and the drum gear 13 from disengaging from each other during printing and to prevent the carriage 12 from overrunning. By the first function of the control lever, the printing of every digit is surely completed.

The manner of operation to select symbol printing or numeric printing will be described hereinafter.

For the sake of explanation it is assumed that at the start of printing the carriage is in its right-hand end home position as shown in FIG. 1. In this starting position, the driving gear 33 and the clutch gear 43 are in mesh with each other and rotate as shown in FIG. 2 which is a schematic view looking from the backside of the carriage 12 in the starting position.

In the above shown position, one end 45*b* of the coil spring 45 is in engagement with the free end 48*a* of the PF lever 48 and the coil spring 45 is in a relaxed state. Therefore, the rotation of the clutch gear 43 can not be transmitted to the PF worm 46. This position is considered to be the home position of the carriage for the first printing. Then, the first printing is started by applying the current to the solenoid 3 to move the carriage for carry in the manner described above. However, it should be noted that the cam plate 22 has only one projection 25 on the high level at which the symbol printing hammer 19 is now engageable with any projection and that direct under the projection 25 there is provided on low level projection 23 with which the numeric printing hammer 18 is engageable (see FIG. 6).

Figure 20:
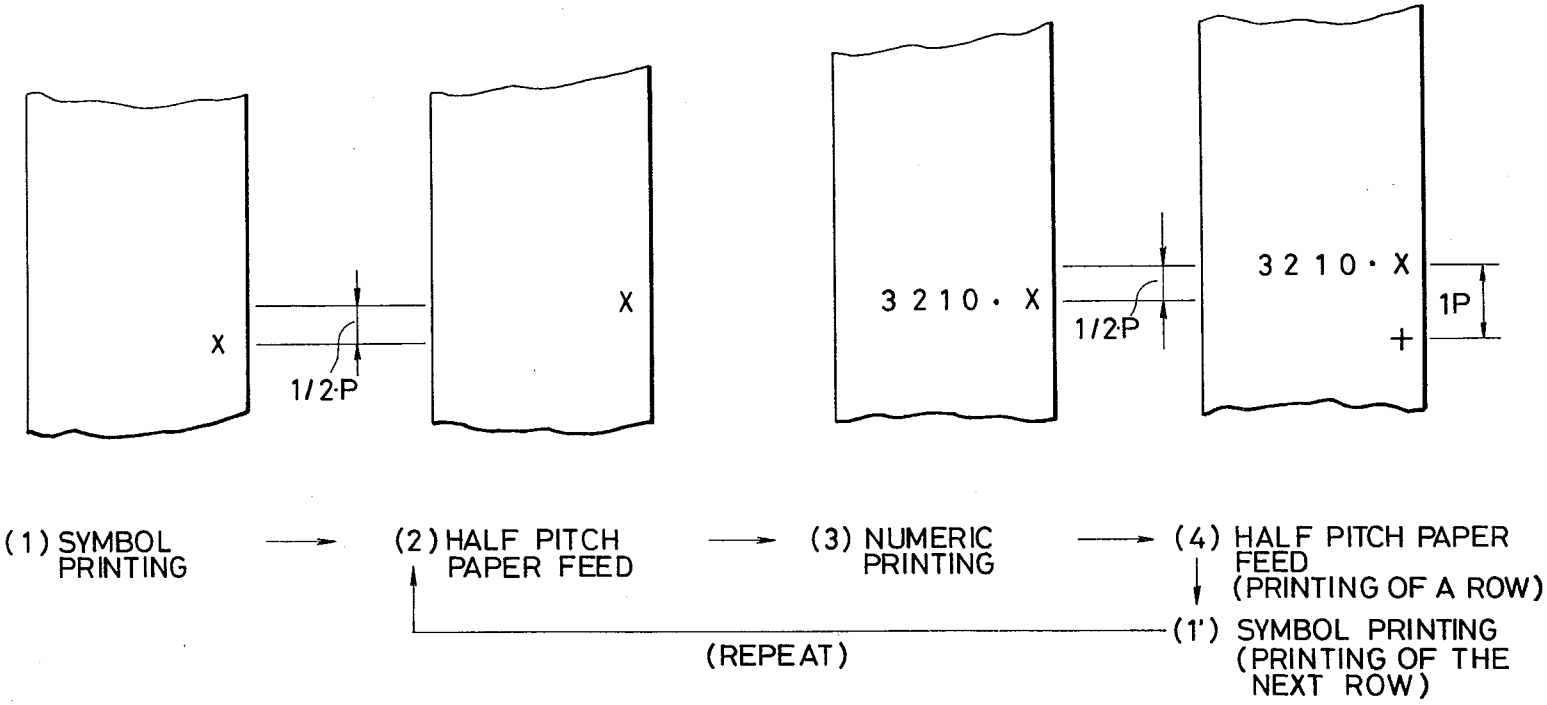
FIG. 20 shows the relation in timing between paper feed and printing.
Figure 21:
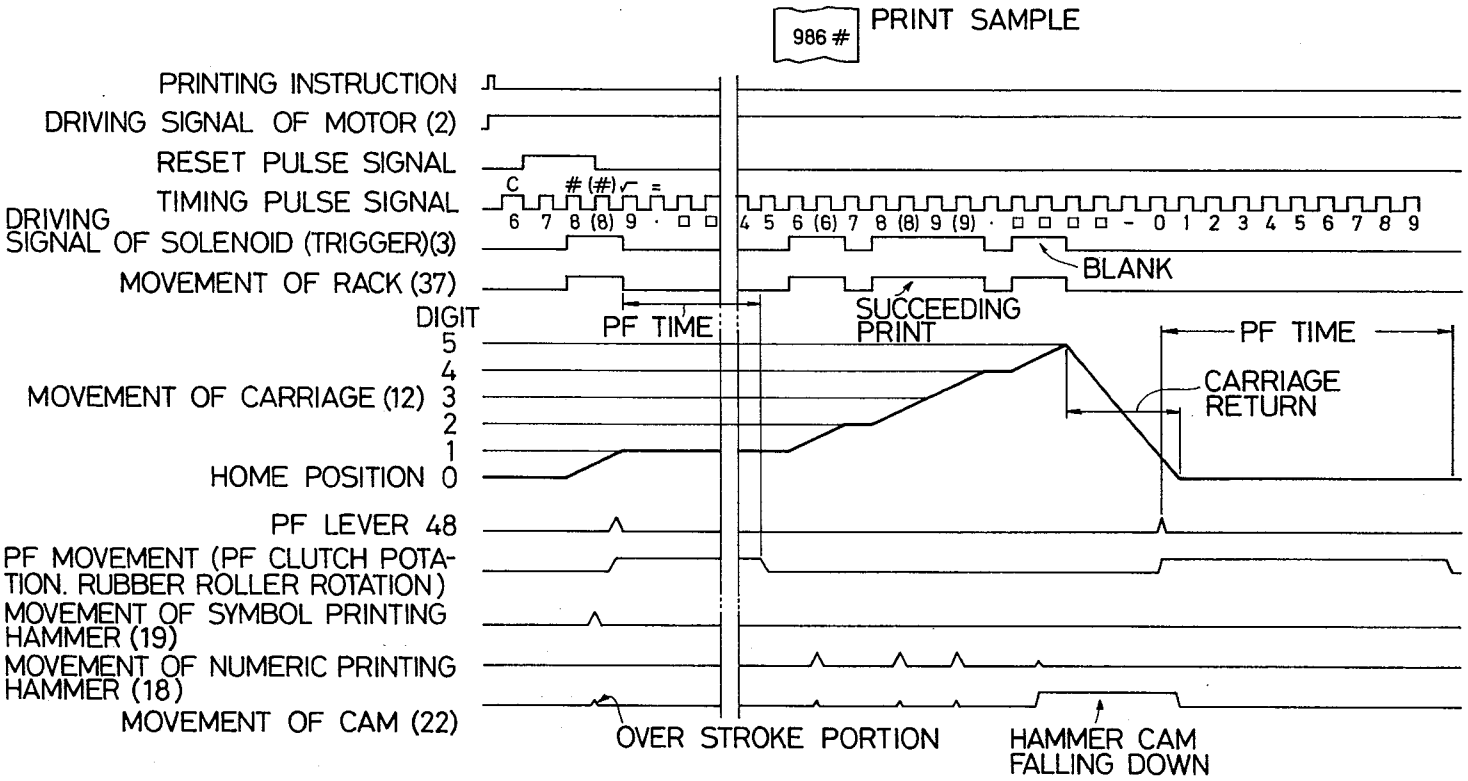
FIG. 21 is a timing chart showing the movements of the respective members of the printer.

Therefore, as seen from FIG. 20-(1), the character first printed is always a symbol.

With a further movement of the carriage 12 for carry, the projection 12*a* on the carriage comes into engagement with the other end 48*b* of the PF lever 48 and rotates the PF lever 48 counter-clockwise as viewed in FIG. 2. Thereby the spring end 45*b* is disengaged from the lever end 48*a* as suggested by the phantom line in FIG. 2. In this disengaged state, the coil spring 45 winds itself round the boss 43*a*. At the time, the PF worm 46 is rotated by the spring force. However, as the carriage 12 is moving in the direction of arrow in FIG. 2, the projection 12*a* on the carriage passes over the PF lever 48 in a short time. Therefore, the PF lever 48 is released from the engagement with the projection 12*a*. On the disengagement from the projection 12*a*, the paper feed lever is returned to its starting position by the biasing force of a return spring not shown. After one revolution of the PF worm 46, the end 45*b* of the coil spring 45 again comes into engagement with the end 48*a* of the PF lever 48. Thereby the coil spring 45 becomes again relaxed and the spring clutch is rendered inactive. As the PF worm 46 rotates just one revolution as described above, the paper feed gear 49 and therefore also the rubber roller 50 are rotated to feed the printing paper P by a half pitch as illustrated in FIG. 20-(2).

In this manner, the symbol now printed is raised up to the same level as that of a numeric to be printed next. Thus, the first printed symbol is aligned with the next printed numeric without any need of up-and-down movement of the type drum as required in the case of a common typewriter. Symbol and numerical characters can be printed on the same line without the type drum being vertically moved (FIG. 20-(3)).

Figure 15:
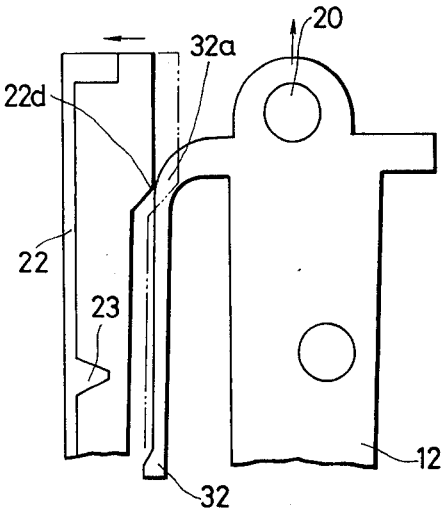
FIG. 15 is a side view of the essential part illustrating the operation for carriage return.
Figure 16:
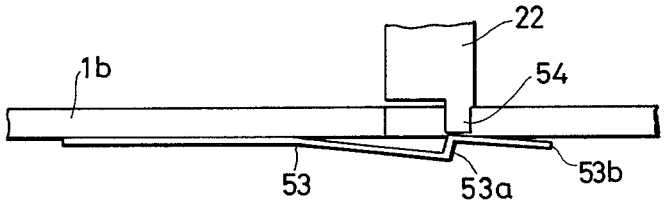
FIGS. 16 through 18 illustrate the control operation of the cam member at carriage return.
Figure 17:
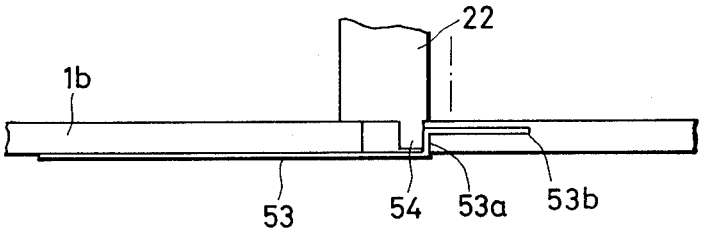

The above numeric printing is repeated on the same line until the necessary number of digits has been printed. When the carriage 12 reaches the left-hand end position of the moving course as viewed in FIG. 1, the base portion 32*a* of the pawl 32 on the carriage comes into contact with an extension 22*d* formed at the left-hand end of the cam plate 22 and extending toward the carriage from the cam plate as shown in FIG. 15. Through the contact, the carriage rotates the cam plate 22 counter-clockwise against the biasing force of a spring not shown. FIG. 7 illustrates this counter-clockwise rotation of the cam plate 22. As a result, as shown in FIGS. 16 and 17, the state of engagement between the projection 54 of the cam plate and the leaf spring 53 at the bent portion 53*a* changes. The projection 54 on the cam plate is stepped down from the position in FIG. 16 to the position in FIG. 17. The cam plate 22 is locked in the stepped-down position by the bent portion 53*a* of the leaf spring 53. In this position, the pawl 32 on the carriage is released from engagement with the projection 26 on the cam plate 22. Therefore, the carriage 12 is returned to the right-hand end position by the return spring 29. To attain rapid carriage return, the return spring 29 is preset to have a larger spring force than the spring 36 by which the control lever 35 is pressed against the rack 37 (FIG. 3). When the carriage 12 comes back into the home position, its projection 12*a* rotates again one end 48*d* of the PF lever 48 counter-clockwise as viewed in FIG. 2. Thereby, the printing paper P is fed by a second half pitch and the total amount of the paper feed in this cycle becomes one pitch as illustrated in FIG. 20-(4).

Figure 18:
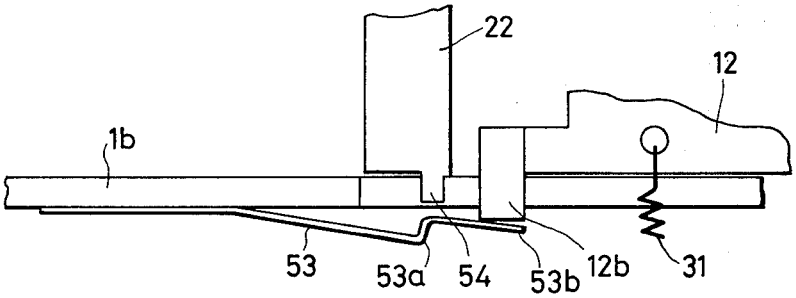

Also, when the carriage 12 enters the home position, the projection 12*b* provided at the right-hand end of the carriage comes into contact with the leaf spring 53 and pushes the free end 53*b* of the leaf spring down as shown in FIG. 18. Therefore, the projection 54 of the cam plate 22 is released from the locked state by the stepped portion 53*a* of the leaf spring. The cam plate 22 is allowed to be rotated by a spring not shown. Thus, the cam plate rotates clockwise as viewed in FIG. 7 and returns back to its starting position.

In this manner, one printing cycle is completed.

When it is wished to return the carriage 12 to the home position on the way along the line without printing over all of the digits in one row, an operation somewhat different from the above must be done, which is described hereinafter.

Figure 19:
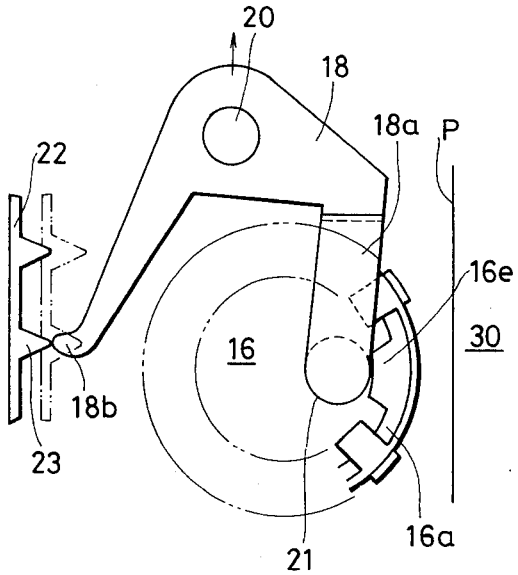
FIG. 19 is a view illustrating the movement of the printing hammer in non-printing position.

To this end, an inward projection 16*e* as shown in FIG. 19 is provided on the inner surface of the base 16*a* of the type drum 16. The position of the inward projection 16*e* is the non-printing position in which no printing can be effected.

When the printing roller 21 of the hammer 18 is in the position opposed to the projection 16*e*, the latter hinders the hammer from rotating about the rotation axis 20 thereby preventing the solenoid 3 from being actuated at this position. In this position when the arm 18*b* of the printing hammer 18 comes into contact with the cam projection 23 on the cam plate 22, the arm 18*b* does not move but the cam projection 23 is pushed back by the arm 18*b* in contact with the above. As the cam plate 22 is pushed by the arm of the hammer, the former is rotated in a similar manner to the above and the projection 54 on the cam plate 22 is locked by the stepped portion 53*a* of the leaf spring 53 in the manner shown in FIG. 17. Therefore, the carriage 12 is allowed to return back to the home position to terminate the printing cycle.

When it is wished to perform the paper feed only without printing, it is attained by actuating the solenoid 3 two times to the above inward projection 16*e* of the type drum 16. By doing so, the printing paper is fed by one pitch and the carriage is returned to the home position.

While the invention has been particularly shown and described with reference to an embodiment thereof, it will be understood that various modifications may be made therein.

For example, the ratio of the number of the teeth of the drum gear 13 to the number of the type sections on the circumference of the type drum 16 is never limited to 1:1 only as in the case of the shown embodiment. The number of the gear teeth may be a multiple of the number of the type drum sections by any whole number.

Further, it is not always necessary to form the numeric type belt 16*b* and the symbol type belt 16*c* as two separate type belts. They may be united together into one belt round the type drum. If it is desired, three or more type belts may be used. In this case, printing in two colors, for example, red and black may be possible by providing two ink rollers 27 at two different levels, for example, the upper ink roller for black and the lower one for red.

As readily understood from the foregoing, the serial printer according to the invention has many advantages over the prior art ones, for example, of the type in which type selection and print carry are carried out separately. According to the invention, the type selection and the print digit-up can be carried out at the same time. Therefore, as compared to the prior art printers, the printing speed is increased remarkably while reducing the loss of time. Further, according to the invention, the type is pushed against the printing paper by means of a cam. This has a remarkable effect of decreasing the impact noise. Compared with the conventional impact printers, it may be said that the printer according to the invention generates substantially no impact noise at printing. Thus, there can be obtained a "silent" printer. No loss of energy and less variation of load are mechanical advantages of the printer according to the invention. For these advantages, the electric power consumed by the printer is very small. As the power source, there may be used dry cell or the like. As the motor there may be used a cheap free-run motor. The present invention, therefore, enables to provide a small and inexpensive printer.

What we claim is:

1. A small serial printer comprising:

a type drum adapted to rotate about an axis perpendicular to the direction of a line of print on a printing paper, said type drum including a hollow cylindrical base member and at least two elastic type belts disposed around said base member at different levels on the circumference of said base member, each type belt having a plurality of types arranged on the surface of the type belt;

a carriage for carrying said type drum in the direction of the line of print; and a hammer rotatably supported about an axis having a first end which leads into the interior of said type drum and is disposed opposite to the backside of the types of said type belts, and having a second end outside of said type drum and disposed to contact a cam member to rotate said hammer during movement of said carriage, wherein the first end of the hammer strikes the backside of one type of one type belt so that the type is pushed out against the printing paper to effect printing, wherein said carriage has a driving gear which engages a drum gear and said printer has a clutch gear provided on a frame side of said printer to mesh with said driving gear when said carriage comes to a determined position, said clutch gear being interlocked with a paper feed worm gear through a spring clutch, so that the printing paper is fed by rotating a paper feed roller through a paper feed gear in mesh with said worm gear and said spring clutch is controlled through a lever which engages said carriage.

2. A small serial printer according to claim 1, wherein one type belt is for numerical printing and the other type belt is for symbol printing, so that when printing with one type belt is completed, the printing paper is fed by a half pitch and then subsequent printing with the other type belt is carried out whereby the numeral and the symbol can be printed on the same line on the same printing paper.

3. A small serial printer according to claim 2, characterized in that after the completion of printing on the same line, the printing paper is fed further by a half pitch.

* * * * *